United States Patent [19]

Bruderer et al.

[11] Patent Number: 4,860,632

[45] Date of Patent: Aug. 29, 1989

[54] APPARATUS FOR RADIALLY SECURING A CARTRIDGE INSERTED BY A BREECHBLOCK INTO THE WEAPON BARREL OF A FIRING WEAPON

[75] Inventors: Werner Bruderer, Zürich; Erwin Bohler, Dübendorf, both of Switzerland

[73] Assignee: Werkzeugmaschinenfabrik Oerlikon-Bührle AG, Zürich, Switzerland

[21] Appl. No.: 31,861

[22] Filed: Mar. 30, 1987

[30] Foreign Application Priority Data

Apr. 10, 1986 [CH] Switzerland ..... 417/86

[51] Int. Cl.[4] ..... F41C 15/06

[52] U.S. Cl. ..... 89/33.25; 42/25

[58] Field of Search ..... 89/33.16, 33.17, 33.25, 89/33.2, 11, 12, 9, 13.85; 42/25

[56] References Cited

U.S. PATENT DOCUMENTS

| | | | |
|---|---|---|---|
| 1,749,137 | 3/1930 | Hudson | 89/11 |
| 1,783,577 | 12/1930 | Mascarucci | 89/149 |
| 3,146,673 | 9/1964 | Reed | 89/126 |
| 4,216,698 | 8/1980 | Chiabrandy | 89/12 |
| 4,550,641 | 11/1985 | Bruderer et al. | 89/12 |

FOREIGN PATENT DOCUMENTS

| | | | |
|---|---|---|---|
| 0111240 | 6/1984 | European Pat. Off. | 89/12 |
| 2937860 | 4/1980 | Fed. Rep. of Germany | 89/12 |
| 186952 | 10/1922 | United Kingdom | 89/11 |

*Primary Examiner*—Deborah L. Kyle
*Assistant Examiner*—Stephen Johnson
*Attorney, Agent, or Firm*—Werner W. Kleeman

[57] ABSTRACT

When a cartridge is inserted into the weapon barrel of a firing weapon by a forwardly and rearwardly reciprocatable breechblock, a front end surface of the breechblock impacts against the base of the cartridge. The cartridge to be inserted must be secured so that it cannot slide off such front end surface of the breechblock during cartridge insertion. This cartridge securement is attained in that the cartridge is held against radial displacement by an extracting or withdrawal claw and diametrically opposite thereto by means of a securing cam or lug provided at a feeler element or pin. To eject the empty cartridge case and during the insertion of the next cartridge, the feeler element or pin together with the securing cam or lug is pushed back by means of a control cam or rail.

3 Claims, 5 Drawing Sheets

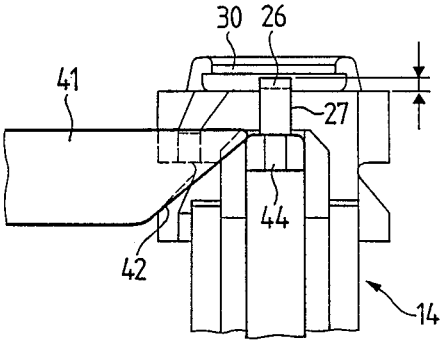
FIG. 6
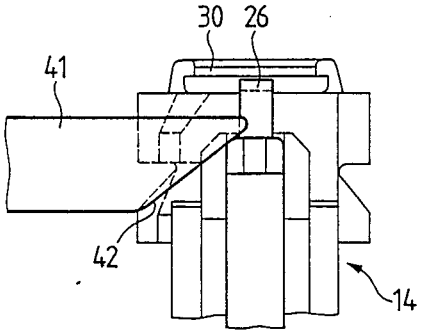
FIG. 7
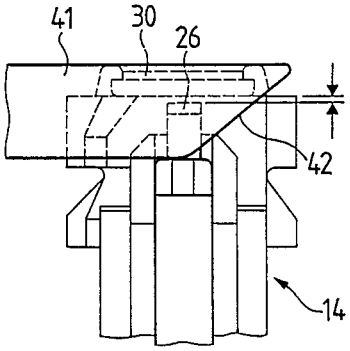
FIG. 8
FIG. 9
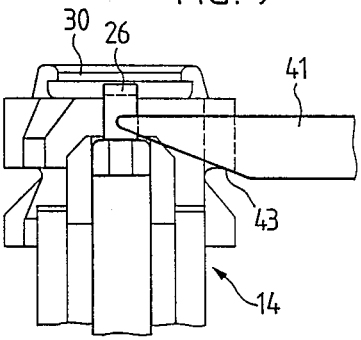
FIG. 10
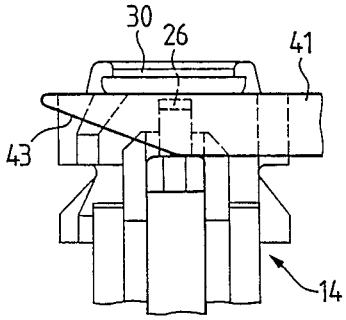

APPARATUS FOR RADIALLY SECURING A CARTRIDGE INSERTED BY A BREECHBLOCK INTO THE WEAPON BARREL OF A FIRING WEAPON

BACKGROUND OF THE INVENTION

The present invention broadly relates to a new and improved construction of an apparatus for radially securing a cartridge upon being inserted by means of a breechblock into the weapon barrel of a firing weapon.

In its more specific aspects, the present invention relates to a new and improved construction of an apparatus for radially securing a cartridge which is to be inserted into the weapon barrel of an externally driven firing weapon by means of a breechblock constrained to move or reciprocate forwards and backwards. The apparatus possesses at least one weapon barrel rotating within a weapon housing. There is also provided an extracting or withdrawal hook or claw at the breechblock which engages in an extracting or withdrawal groove of the cartridge case or sleeve and which prevents the cartridge from slipping off the breechblock head in a radial direction. Additionally, the apparatus contains a feeler element or pin which is disposed radially opposite to the extracting or withdrawal hook or claw and which determines or senses whether a cartridge has been inserted into the weapon barrel. This feeler element or pin is displaceable in the axial direction thereof and is loaded by a spring which strives to hold the feeler element or pin in its forwardmost position. When a cartridge is present, the feeler element or pin can be slid or displaced into its rearmost position, against the force of the spring, by means of the base of the cartridge case.

In an externally driven firing weapon of this type, as known from European Published Patent Application No. 11,240, published June 20, 1984, cognate with U.S. Pat. No. 4,550,641, granted Nov. 5, 1985 there is provided a security or safety apparatus which prevents unlocking or release of the breechblock when there occurs a firing delay. In the case of firing weapons of the Gatling gun type, the danger exists that with a firing delay the cartridge will still be fired or ignited after the unlocking or release of the breechblock which is constrained to move forwards and backwards. A firing or ignition of the cartridge after the breechblock has been unlocked or released is undesired. This security or safety apparatus possesses a feeler pin serving to establish whether or not a cartridge has been inserted. This known apparatus responds either to the gas pressure, the recoil of the firing weapon, the forward travel of the firing weapon, or to a bulging of the cartridge case and causes a separation or disconnection of the breechblock head from its breechblock carrier. As a result, the breechblock head remains in its locked position if the cartridge does not duly fire or ignite after it has been pierced by the firing pin. However, this known firing weapon does not possess any securing or safety apparatus which, when the cartridge is inserted by means of the breechblock into the weapon barrel, can prevent a radial sliding off of the cartridge from the breechblock.

It is conventional to provide a disk-shaped recess at the front end of the breechblock, into which projects the rear end of the cartridge upon being inserted into the firing weapon barrel, whereby the cartridge is secured against any lateral displacement. However, to ensure that the cartridge can engage into this discshaped recess at the front end of the breechblock, the extracting or withdrawal hook or claw must be pivoted out and subsequently pivoted in again,in order that it projects into the extracting or withdrawal groove of the cartridge.

SUMMARY OF THE INVENTION

Therefore, with the foregoing in mind, it is a primary object of the present invention to provide a new and improved construction of an apparatus for radially securing a cartridge which is being inserted by a breechblock into the weapon barrel of a firing weapon and which apparatus is not afflicted with the aforementioned drawbacks and shortcomings of the prior art constructions.

Another and more specific object of the present invention aims at the provision of an improved construction of an apparatus for radially securing a cartridge which is being inserted by means of a breechblock into the weapon barrel, without the need for the extracting or withdrawal hook or claw or equivalent structure having to be pivotably or swivelably constructed, and to the extent possible there should be employed for the securing apparatus the components or parts of the safety apparatus for the firing or ignition delay.

Now in order to implement these and still further objects of the invention which will become more readily apparent as the description proceeds, the securing apparatus of the present invention is manifested by the features that the feeler element or pin possesses an axially protruding or projecting securing cam or lug which laterally bears against the edge of the base of the cartridge in order to secure the cartridge against laterally sliding out of the extracting or withdrawal hook or claw. Furthermore, there is provided a control cam or rail which is fastened at the weapon housing in order to push back the feeler element or pin during infeeding the cartridge into a position in front of the weapon breechblock.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIGS. 6 to 10 respectively show a detail of FIG. 4, and depicting various positions of the control cam or rail.

DETAILED DESCRIPTION OF THE PREFERRED EMBODIMENTS

Figure 1:
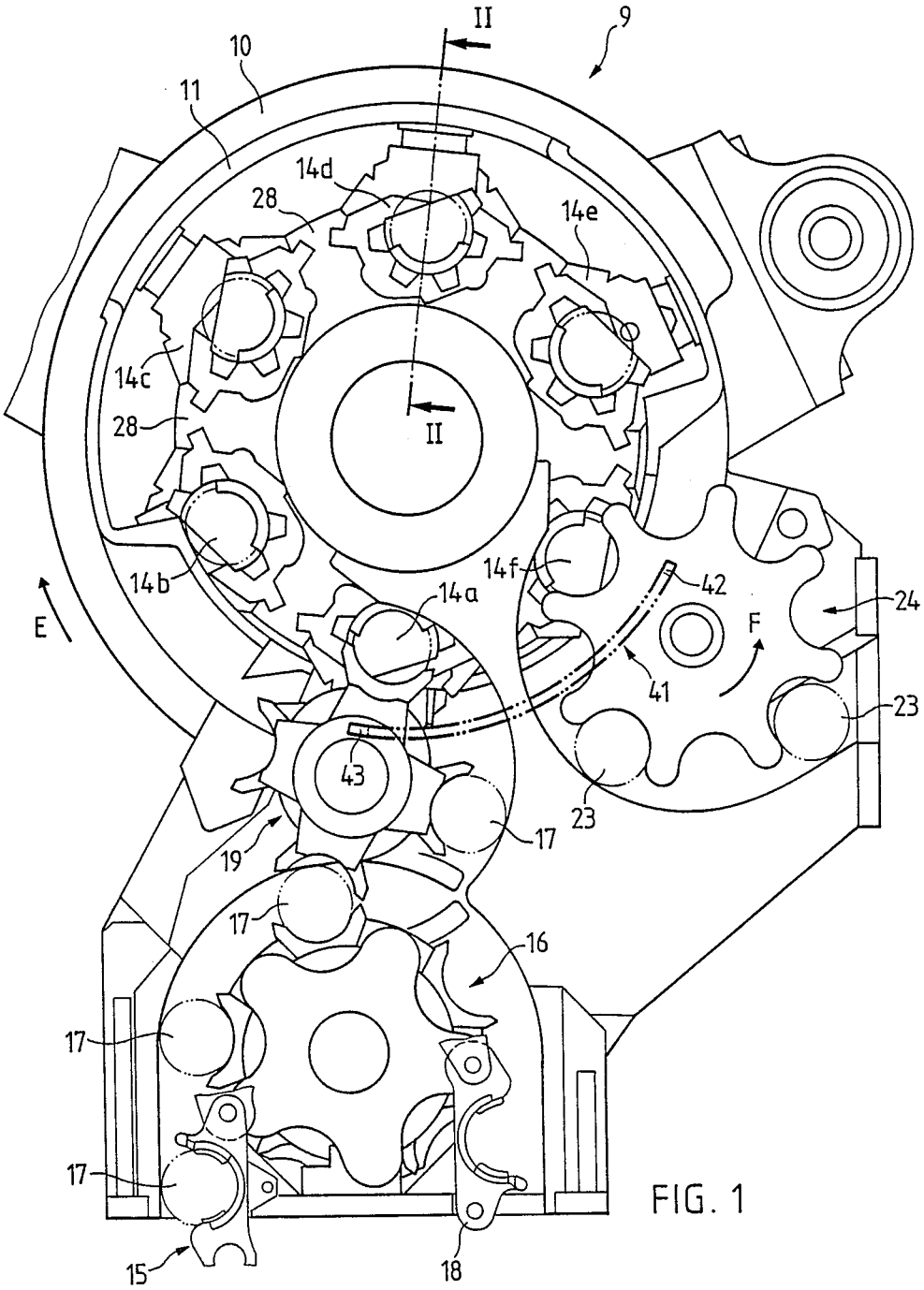
FIG. 1 is a cross-sectional view through an automatic firing weapon and depicted in schematic representation.
Figure 2:
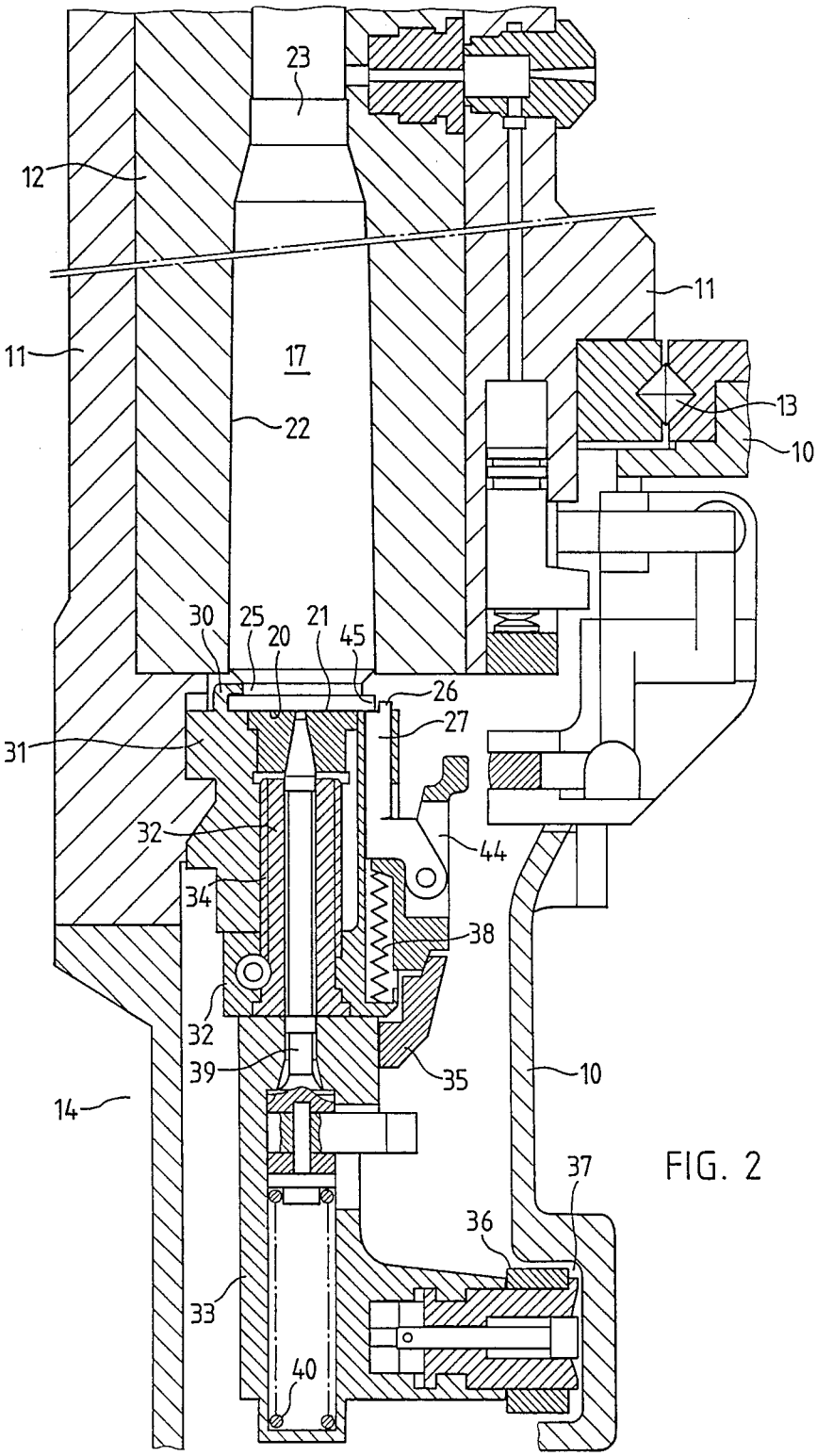
FIG. 2 is a schematic longitudinal section on an enlarged scale and taken substantially along the line II—II of the firing weapon shown in FIG. 1.
Figure 4:
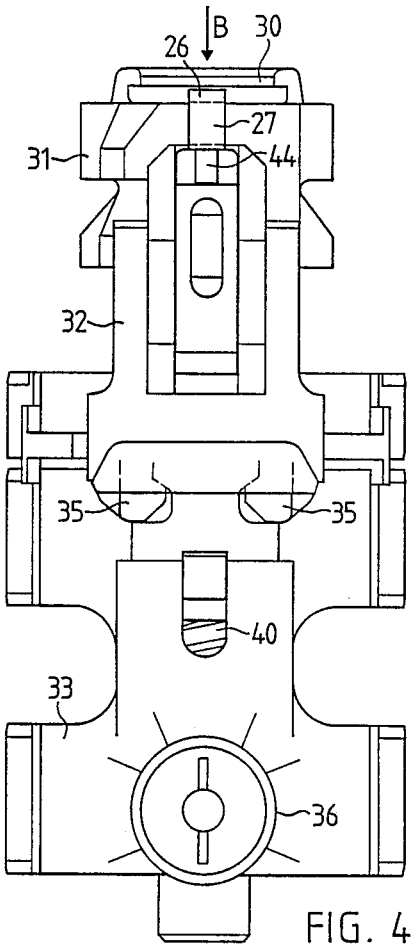
FIG. 4 is a front view of the breechblock shown in FIG. 3 looking in the direction of the arrow A thereof.

Describing now the drawings, it is to be understood that to simplify the showing thereof only enough of the structure of the inventive securing apparatus has been illustrated therein as needed to enable one skilled in the art to readily understand the underlying principles and concepts of the present invention. Turning now specifically to FIGS. 1 and 2 of the drawings, there is depicted therein a rotor 11 which is appropriately rotatably mounted in a weapon housing 10 with the aid of a suitable ball bearing 13. By way of example, six weapon barrels 12, of which only one such weapon barrel 12 is visible in FIG. 2, are fastened in this rotor 11 by means of suitable bayonet locks as is known in this art. A respective breechblock, individually indicated by reference character 14*a* to 14*f* in FIG. 1 but generally by reference numeral 14 in FIGS. 2 and 6 to 10, is operatively associated with each weapon barrel 12. Each breechblock 14 (or 14*a* to 14*f* in FIG. 1) is slidably or displaceably mounted for reciprocatory motion in associated longitudinal or lengthwise guides 28 within the rotor 11. These six breechblocks 14*a* to 14*f* are shown viewed from the front in FIG. 1.

As depicted in FIG. 1, cartridges 17 are delivered to the firing weapon 9 by means of an endless bucket conveyor chain 15 which is trained about a star wheel 16. The cartridges 17 located in the individual buckets 18 or the like of the bucket conveyor chain 15 are combed or cammed out of the bucket conveyor chain 15 by means of a star wheel 19 or equivalent structure and moved to a position in front of the relevant breechblock, such as the breechblock 14*a* of the firing weapon 9 as depicted in FIG. 1, until the lengthwise axis of the cartridge 17 coincides with or is in alignment with the lengthwise axis of the associated weapon barrel 12, as depicted in FIG. 2. The base 20 of the cartridge 17 thus comes to lie upon the front surface or front end surface 21 of the breechblock 14 depicted in FIG. 2. When the breechblock, such as the breechblock 14*a* of FIG. 1, is moved to its forwardmost position, it pushes or rams the cartridge 17 into the loading chamber or cartridge chamber 22 of the weapon barrel 12. This displacement of the breechblock 14 (FIG. 2) or 14*a* (FIG. 1) is effected in known manner by virtue of the rotation of the rotor 11 in the direction of the arrow E.

As soon as the cartridge 17 has been fired, the empty cartridge case or sleeve 23 is again retracted out of the cartridge chamber 22 of the weapon barrel 12 by means of the breechblock 14 (FIG. 2) and ejected from the firing weapon by the action of a further star wheel 24 (FIG. 1) or equivalent structure. This further star wheel 24 rotates in the direction of the arrow F. The construction of such a firing weapon 9 with a plurality of weapon barrels 12 and its mode of operation are assumed to be well known in this technology and therefore only has been described herein insofar as such is necessary for the understanding of the present invention.

Figure 5:
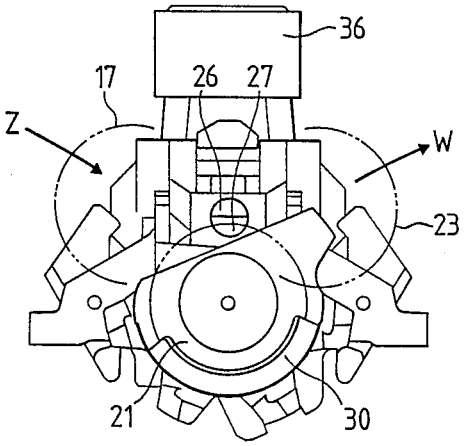
FIG. 5 is a front view of the breechblock shown in FIG. 4 looking in the direction of the arrow B thereof.

According to FIGS. 2 and 5, there is provided at the front surface or front end surface 21 of the there depicted breechblock 14 an extracting or withdrawal element, such as an extracting or withdrawal hook or claw 30 which projects into an extracting or withdrawal groove 25 of the cartridge case 23. So that the cartridge 17 cannot fall out of the extracting or withdrawal hook or claw 30 when inserted into the associated weapon barrel 12, an axially projecting securing or safety element, such as securing or safety cam or lug 26 is provided or mounted at a feeler element, such as a feeler pin 27 which is located diagonally or diametrically opposite the extracting or withdrawal hook or claw 30. The securing or safety element 26 bears against an edge of the cartridge base 20 in order to secure the cartridge 17 against sliding out of the extracting or withdrawal hook or claw 30. In order that the cartridge 17 can be inserted into the extracting hook or claw 30, the feeler element or pin 27 together with the securing cam or lug 26 must be pulled back or retracted as will be described more fully hereinafter. As depicted in FIG. 5, the cartridge 17 is delivered in the direction of the arrow Z and the empty cartridge case 23 is removed in the direction of the arrow W. This is only possible if the feeler element or pin 27 together with the securing cam or lug 26 has been retracted to such an extent that the base 20 of the cartridge case can slide upon the front surface 21 of the breechblock 14.

As will be readily seen by further reverting to FIG. 2, the therein depicted breechblock 14 consists of a breechblock head 31, a breechblock head holder 32 and a breechblock carrier 33. The breechblock head 31 is threaded or screwed by means of a coarse or coarse-pitch screw or thread 34 onto the breechblock head holder 32 and this breechblock head holder 32 is appropriately operatively coupled by means of a lever or lever member 35 with the breechblock carrier 33. A roller or roll 36, which is rotatably mounted on the breechblock carrier 33, engagingly projects into a control groove 37 of the weapon housing 10.

Figure 3:
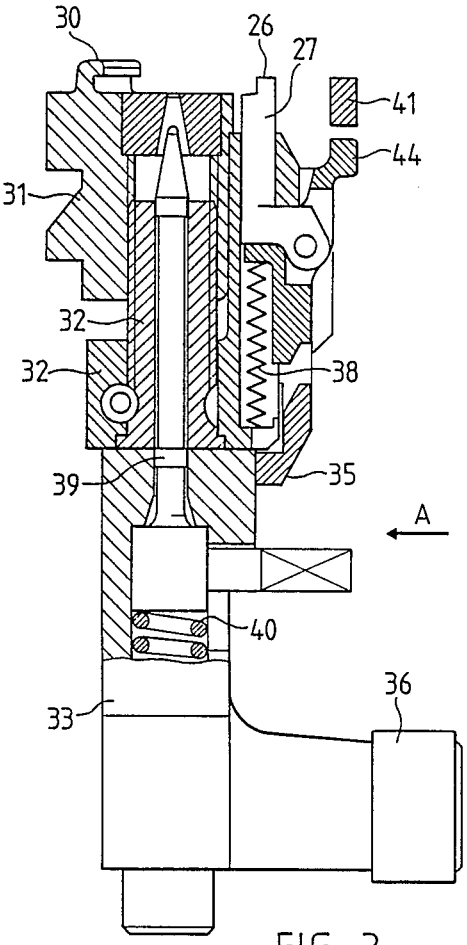
FIG. 3 is a sectional view of part of the arrangement of FIG. 2 depicting the breechblock in a different position.

When the rotor 11 is rotated in the weapon housing 10, then the breechblock 14 (FIG. 2) is retracted or rearwardly displaced to such an extent, by means of the control groove 37, that the empty cartridge case 23 can be ejected and a further cartridge 17 can be infed. During this time the breechblock head 31 is rotated on the breechblock head holder 32 and, at the same time, is shifted from the position according to FIG. 2 into the position according to FIG. 3. The feeler element or pin 27 is slidably or displaceably guided in the breechblock head holder 32 and is loaded by a spring 38 or the like. This feeler element or pin 27 is retained by means of the cartridge 17 in its rearmost position, as shown in FIG. 2, and in conjunction with the displacement of the breechblock head 31 is moved forward, as shown in FIG. 3, so that the security cam or lug 26 always protrudes or projects by the same amount over the front surface 21 of the breechblock 14. A firing or ignition pin 39 is slidably or displaceably mounted in the breechblock carrier 33 and loaded by a spring 40.

As depicted in FIGS. 6 to 10, a control cam or rail 41 is provided in order to push the feeler element or pin 27 so far back that the security or safety cam or lug 26 no longer protrudes over the front surface 21 of the breechblock 14, so that the empty cartridge case 23 can be ejected and the next cartridge 17 can be infed or delivered. The control cam or rail 41 is fastened at the weapon housing 10, as is particularly shown in FIG. 1. This control cam or rail 41 possesses at one of its ends a steeper control surface or cam portion 42 and at its other end a flatter control surface or cam portion 43. A lever or lever member 44, pivotably hinged or pivoted at the feeler element or pin 27, pushes or impacts against the control surfaces 42 and 43 (see FIGS. 2, 3 and 6 to 10).

Figure 11:
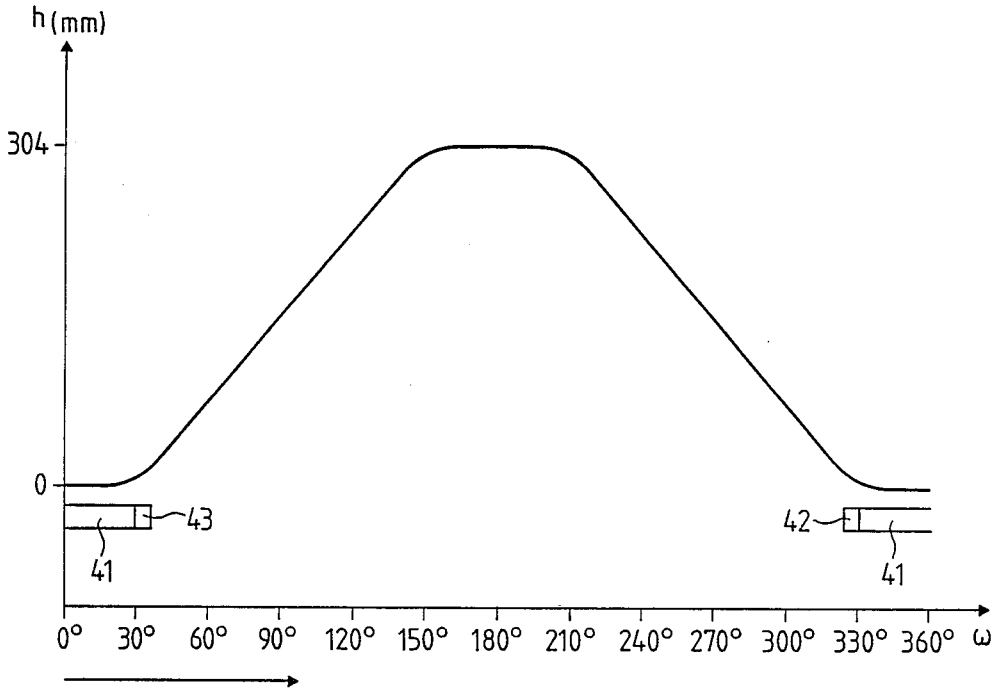
FIG. 11 is a diagram depicting the displacement of the breechblock as a function of the angle of rotation of the rotor of the firing weapon.

Having now had the benefit of the foregoing description of the inventive apparatus for radially securing a cartridge, there will now be described the mode of operation which is as follows:

According to FIG. 1, the rotor 11 is rotated in the weapon housing 10 in the direction of the arrow E during a series firing operation and, at the same time, the therein depicted weapon barrels 12 and the breechblocks 14*a*–14*f* are also rotated. Since the breechblocks 14*a*–14*f* are guided with their associated roller 36 in the control groove 37 as depicted in FIG. 2, during one revolution of the rotor 11 each breechblock 14 is moved from its forwardmost to its rearwardmost position and back again into its initial or forwardmost position. This displacement of the breechblock 14 is illustrated in FIG. 11. During a complete rotation of the rotor 11 through an angle of 360°, the breechblock 14 (FIG. 2) is first located at 0° in its rearwardmost position and remains in this rearwardmost position during the rotation of the rotor 11 through an angle of 30°. During the rotation of the rotor 11 through a further angle of 120°, the breechblock 14 is moved forward and stays in its most forwardmost position during the rotation of the rotor 11 through a further angle of 60°. During the rotation of the rotor 11 through a further angle of 120°, the breechblock 14 is again moved back or retracted and remains in its rearwardmost position during the rotation of the rotor 11 through an angle of 60°, i.e. from the angle 330° to 30°.

As long as the breechblock 14 is located in its rearwardmost position, the feeler element or pin 27 together with the security cam or lug 26 should be retracted to such an extent that the empty cartridge case 23 can be ejected and the next cartridge 17 can be infed or delivered. Accordingly, as best recognized by referring to FIGS. 1, 2, 3 and 6 to 10, the feeler element or pin 27 impacts by means of its pivotable or swivelable lever 44 (FIG. 2) against the steeper control surface or cam portion 42 of the control cam or rail 41 and is pushed back against the force of the spring 38 until the breechblock 14 again begins to move forward and the feeler element or pin 27 together with its pivotable or swivelable lever 44 again slides off the control cam or rail 41 at the flatter control surface 43. As is particularly shown in FIG. 1, the feeler element or pin 27 is pushed back shortly before the empty cartridge case 23 is ejected and released again shortly after the insertion of the next cartridge 17 in front of the breechblock 14.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for radially securing in a weapon barrel of an externally driven firing weapon a cartridge having a cartridge case equipped with an extracting groove, said cartridge further including a cartridge base, comprising:

a weapon housing;

at least one weapon barrel rotatably mounted in said weapon housing;

a forwardly and rearwardly movable breechblock cooperating with said at least one weapon barrel for inserting cartridges into said at least one weapon barrel;

said weapon housing defining a region associated with said breechblock in a rearward position of said breechbock;

said breechblock including a breechblock head;

and extracting element provided at said breechblock and engageable with the extracting groove of the cartridge case of the cartridge and preventing sliding off of the cartridge from the breechblock head in a radial direction;

a feeler element located opposite to said extracting element for determining whether a cartridge has been inserted into said at least one weapon barrel;

means for mounting said feeler element to be displaceable in axial direction thereof between a forward position and a rearward position;

spring means for loading said feeler element;

said spring means striving to retain said feeler element in said forward position of said feeler element;

said feeler element being slidable against the force of said spring means into its rearward position in the presence of a cartridge due to the action of the base of the cartridge upon said feeler element;

said feeler element possessing an axially projecting securing element laterally bearing against an edge of the base of said cartridge case in order to secure said cartridge against sliding out of said extracting element;

control means fastened at said weapon housing in the region of the rearward position of said breechblock;

a lever member operatively associated with said control means in the region of the rearward position of said breechblock;

said feeler element being pivotably hinged at said lever member; and said control means in the region of the rearward position of said breechblock cooperating with said lever member and thereby pushing back said feeler element at least during such time as said cartridge is infed into a position in front of said breechblock.

2. An apparatus for radially securing in a weapon barrel of an externally driven firing weapon a cartridge having a cartridge case equipped with an extracting groove, said cartridge further including a cartridge base, comprising:

a weapon housing;

at least one weapon barrel rotatably mounted in said weapon housing;

a breechblock movable between a forward position and a rearward position relative to said weapon housing and cooperating with said at least one weapon barrel for inserting cartridges into said at least one weapon barrel;

said breechblock including a breechblock head;

an extracting hook provided at said breechblock and engageable with the extracting groove of the cartridge case of the cartridge nd preventing sliding off of the cartridge from the breechblock head in a radial direction;

spring-loaded feeler means disposed radially opposite to said extracting hook for determining whether a cartridge has been inserted into said at least one weapon barrel;

said spring-loaded feeler means being mounted at said breechblock for displacement in axial direction of said spring-loaded feeler means between a forwardmost position and a rearwardmost position;

said spring-loaded feeler means being slidable against the force of its spring load into its rearwardmost position in the presence of a cartridge due to the action of the base of the cartridge upon said feeler means;

said spring-loaded feeler means possessing an axially projecting securing lug laterally bearing against an edge of the base of said cartridge case in order to secure said cartridge against sliding out of said extracting hook;

a control rail solely cooperating with said spring-loaded feeler means and fastened at said weapon housing in association with the rearward position of said breechblock;

said control rail pushing back said spring-loaded feeler means at least when said cartridge is infed into a position in front of said breechblock;

said spring-loaded feeler means comprising:

a spring-loaded lever mounted at said breechblock for displacement against the spring load acting upon said spring-loaded lever in said axial direction of said feeler means;

a feeler element pivotably connected to said spring-loaded lever and for determining the presence of said cartridge inserted into said weapon barrel;

said feeler element possessing said axially projecting securing lug laterally bearing against said edge of the base of said cartridge case in order to secure said cartridge against sliding out of said extracting hook; and said control rail cooperating with said spring-loaded lever and pushing back said spring-loaded lever conjointly with said feeler element against said spring load acting upon said spring-loaded lever, when said cartridge is infed into said position in front of said breechblock.

3. The apparatus as defined in claim 2, further including;

said breechblock further including a breechblock head holder cooperating with said breechblock head and a breechblock carrier cooperating with said breechblock head holder;

lever means provided for said breechblock carrier for operatively coupling said breechblock head holder with said breechblock carrier; and said spring-loaded lever cooperating with said lever means provided for said breechblock carrier.

* * * * *

UNITED STATES PATENT AND TRADEMARK OFFICE

CERTIFICATE OF CORRECTION

PATENT NO. : 4,860,632

DATED : August 29, 1989

INVENTOR(S) : WERNER BRUDERER and ERWIN BOHLER

It is certified that error appears in the above-identified patent and that said Letters Patent is hereby corrected as shown below:

Column 1, line 38, please delete "No. 11,240" and insert --No. 111,240---

Column 4, line 65, after "pivotably" please delete "hinqed" and insert --hinged--

Signed and Sealed this

Twenty-fifth Day of September, 1990

*Attest:*

HARRY F. MANBECK, JR.

*Attesting Officer*

*Commissioner of Patents and Trademarks*